US006129821A

United States Patent [19]

Kamitahira

[11] Patent Number: 6,129,821

[45] Date of Patent: Oct. 10, 2000

[54] METAL MAGNESIUM ELECTROLYZER

[75] Inventor: Takashi Kamitahira, Itami, Japan

[73] Assignee: Alcan International Limited, West Montreal, Canada

[21] Appl. No.: 09/147,461

[22] PCT Filed: Apr. 30, 1997

[86] PCT No.: PCT/JP97/01490

§ 371 Date: Feb. 18, 1999

§ 102(e) Date: Feb. 18, 1999

[87] PCT Pub. No.: WO98/49373

PCT Pub. Date: Nov. 5, 1998

[51] Int. Cl.[7] ..... C25C 3/00

[52] U.S. Cl. ..... 204/247; 204/244; 204/245

[58] Field of Search ..... 204/244, 245, 204/247, 228.5, 246

[56] References Cited

FOREIGN PATENT DOCUMENTS

| | | |
|---|---|---|
| 33-9655 | 11/1958 | Japan . |
| 45-14649 | 5/1970 | Japan . |
| 6-346268 | 12/1994 | Japan . |
| 9-125281 | 5/1997 | Japan . |

OTHER PUBLICATIONS

Derwent English Abstract of JP 09125281 A, published May 13, 1997.

*Primary Examiner*—Kathryn Gorgos
*Assistant Examiner*—Wesley A. Nicolas
*Attorney, Agent, or Firm*—Oblon, Spivak, McClelland, Maier & Neustadt, P.C.

[57] ABSTRACT

In a metallic Mg electrolyzing device provided with a plurality of electrolytic cells for forming metallic Mg, promotion of current efficiency in each electrolytic cell and decrease in electric power consumption rate are aimed at. In order to transport the $Cl_2$ gas produced as a byproduct in the plurality of electrolytic cells to a $Cl_2$ gas refining equipment, gas from the plurality of electrolytic cells is collectively sucked by use of a blower installed in the main pipe. And an automatic valve is installed in each of the branch pipes which branch out from the main pipe and introduce the $Cl_2$ gas from each electrolytic cell to the main pipe. Each automatic valve is gate type, and its positioner is driven/controlled by air pressure. The suction pressure for sucking $Cl_2$ gas in the plurality of electrolytic cells is detected and the opening degree of the automatic valves is automatically controlled so that each detected pressure is controlled to the target value.

19 Claims, 2 Drawing Sheets

METAL MAGNESIUM ELECTROLYZER

BACKGROUND OF THE INVENTION

1. Field of the Invention

The present invention relates to a metallic Mg electrolyzing device for forming metallic Mg by electrolysis of molten salts containing chloride of Mg, in particular, to a metallic Mg electrolyzing device provided with a plurality of electrolytic cells, $Cl_2$ gas produced as a byproduct therein being collectively sucked.

2. Discussion of the Background

A metallic Mg electrolyzing device industrially used for forming metallic Mg by electrolysis of molten salts containing chloride of Mg uses a plurality of electrolytic cells, in each of which formation of metallic Mg is carried out simultaneously. And with the formation of metallic Mg, $Cl_2$ gas is produced as a byproduct in each electrolytic cell. The $Cl_2$ gas produced as a byproduct in each electrolytic cell is collectively sucked by use of an aspirator installed in the main pipe through branch pipes and transported to a $Cl_2$ gas refining equipment.

In such a metallic Mg electrolyzing device provided with a plurality of electrolytic cells, in order to improve current efficiency and decrease electric power consumption rate, it is important to control the suction pressure for sucking $Cl_2$ gas in each electrolytic cell to a slight negative pressure of −10 to 0 $mmH_2O$ (−0.1 to 0 kPa). The reason is that, if the suction pressure becomes higher, the ratio of the atmospheric air mixed into electrolytic cell is increased, which leads to reducing current efficiency.

In the prior art, however, since negative pressure was not controlled individually in each electrolytic cell, the suction pressure for sucking $Cl_2$ gas in each electrolytic cell was not controlled to −10 to 0 $mmH_2O$, which caused reduction in current efficiency.

SUMMARY OF THE INVENTION

It is therefore an object of the present invention to provide a metallic Mg electrolyzing device provided with a plurality of electrolytic cells, wherein negative pressure control is performed individually in each electrolytic cell to achieve promotion of current efficiency.

The possible methods of individually controlling the suction pressure for sucking $Cl_2$ gas in each electrolytic cell is to install an aspirator in each electrolytic cell and to install an aspirator in the main pipe while equipping each branch pipe branching out from the main pipe with an automatic valve. The former method in which an aspirator is installed in each electrolytic cell is not desirable because piping is more complicated by such a method. However, if the latter method in which an automatic valve is equipped for each branch pipe is adopted, it is not easy to individually control negative pressure in each electrolytic cell. The reasons are as follows.

In each electrolytic cell, chloride in the form of powder is produced with the production of $Cl_2$ gas. Since this chloride causes clogging in the pipes, the piping construction needs to be simple. This is why gas from each electrolytic cell is collectively sucked with an aspirator installed in the main pipe. One possible method of individually controlling suction pressure in each electrolytic cell while collectively sucking gas from each electrolytic cell is to equip each branch pipe with an automatic valve. However, if a valve is equipped for the pipe for sucking $Cl_2$ gas, chloride is adhered to the valve or its surroundings, which causes malfunction of the valve in a short period of time. Therefore, in the prior art, even if individual control of negative pressure in each electrolytic cell is intended, it is difficult to perform it, and as a result, reduction in current efficiency is unavoidable.

In the light of the above difficulties, the present inventors have been considering preventive measures against clogging caused by chloride at each automatic valve when each branch pipe is equipped with an automatic valve. As a result, it has been found that, when using a gate type automatic valve, clogging caused by chloride hardly occurs. Further, it has been found that, though an automatic valve is provided with a positioner driven either by air pressure or by electricity to control its opening degree, even when using a positioner driven by air pressure, if its control system is an electrical control system as is conventionally used, the positioner is affected by magnetic field generated by a large electric power supplied to the electrolytic cell, which becomes the cause of the functional defects in the positioner, therefore, a positioner driven/controlled by air pressure is required to overcome the above difficulty.

In order to achieve the above object, a metallic Mg electrolyzing device of the present invention comprises: a plurality of electrolytic cells for forming metallic Mg by electrolysis of molten salts containing chloride of Mg, exhausting means for collectively sucking gas from the plurality of electrolytic cells by use of an aspirator installed in the main pipe through a plurality of branch pipes branching out from the main pipe in order to take out of the electrolytic cells the $Cl_2$ gas which is produced as a byproduct when forming metallic Mg in the plurality of electrolytic cells, each of said branch pipes being equipped with an automatic valve, and control means for detecting the suction pressure for sucking $Cl_2$ gas in the plurality of electrolytic cells, thereby to control the opening degree of the automatic valve installed in each branch pipe, so that each detected pressure shall be controlled to the target value.

The automatic valve used here is preferably a gate valve. A gate type automatic valve is mainly used for slurry piping and the like. The structure is such that the valve intersecting a pipe is evacuated at the time of opening, just like a gate. Due to such a structure, even if slurry or the like adheres to the valve, the adhering matter is scraped off the valve by the pipe at the time of its opening.

Preferably, the automatic valve is also a pneumatic valve which is driven by air pressure to be opened and closed, with the driving rate for opening/closing controlled by air pressure.

The exhausting means is preferably such that it transports the $Cl_2$ gas taken out of the plurality of electrolytic cells to a $Cl_2$ gas refining equipment.

The target value of the suction pressure for sucking $Cl_2$ gas in the plurality of electrolytic cells is preferably set at −10 to 0 $mmH_2O$.

The plurality of branch pipes branching out from the main pipe are preferably configured so that it shall incline down toward the main pipe. In this case, an automatic valve is preferably installed in the inclining down part of each branch pipe. In addition, a dust bunker for capturing powder is preferably provided in the junctions between the main pipe and branch pipes.

DETAILED DESCRIPTION OF THE PREFERRED EMBODIMENTS

The embodiment of the present invention will now be described with reference to FIGS. 1 and 2 of the drawings.

Figure 1:
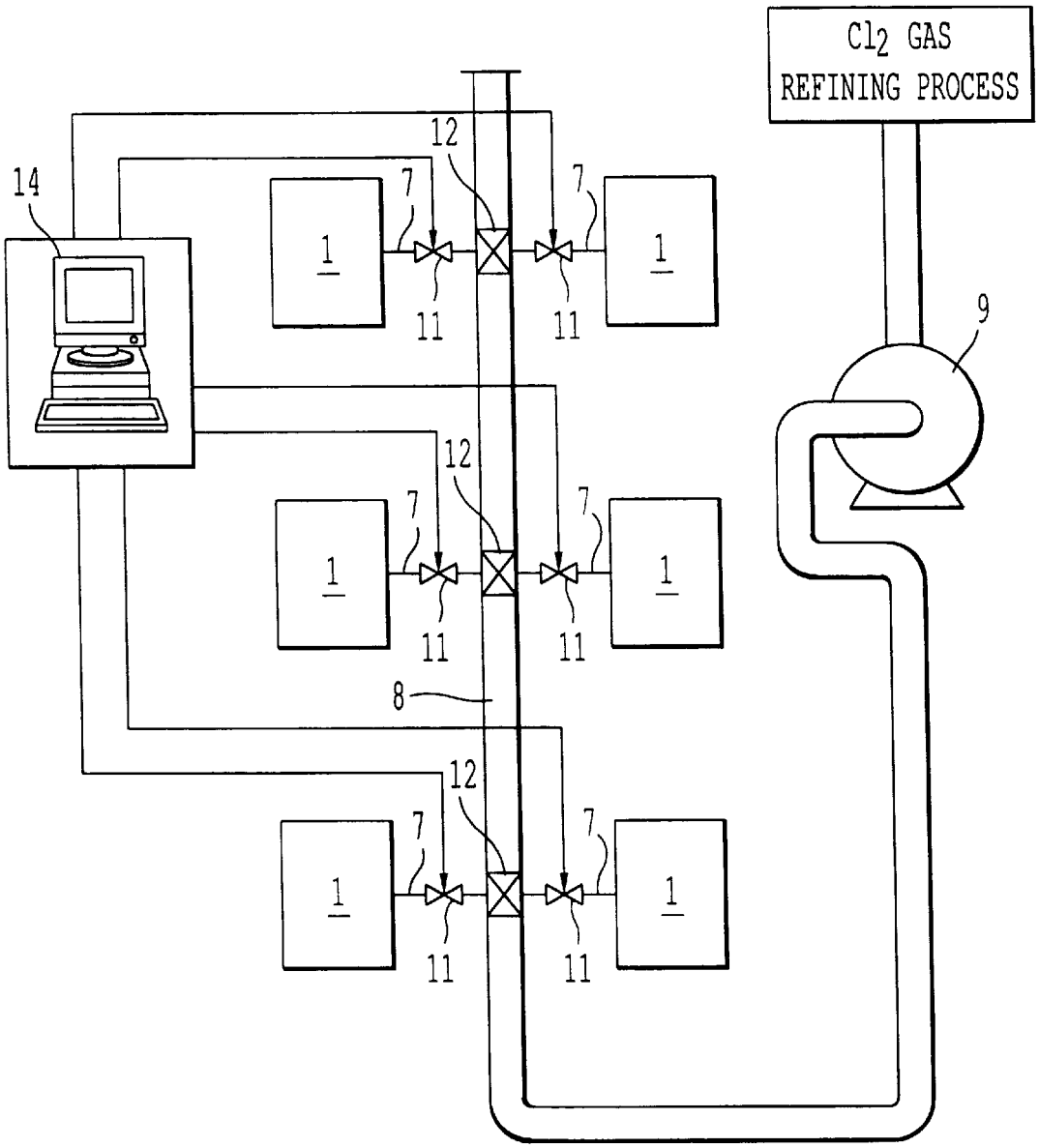
FIG. 1 is a schematic view illustrating the gas transporting system and the control system for controlling the automatic valves installed in the gas transporting system of a metallic Mg electrolyzing device in accordance with one embodiment of the present invention.
Figure 2:
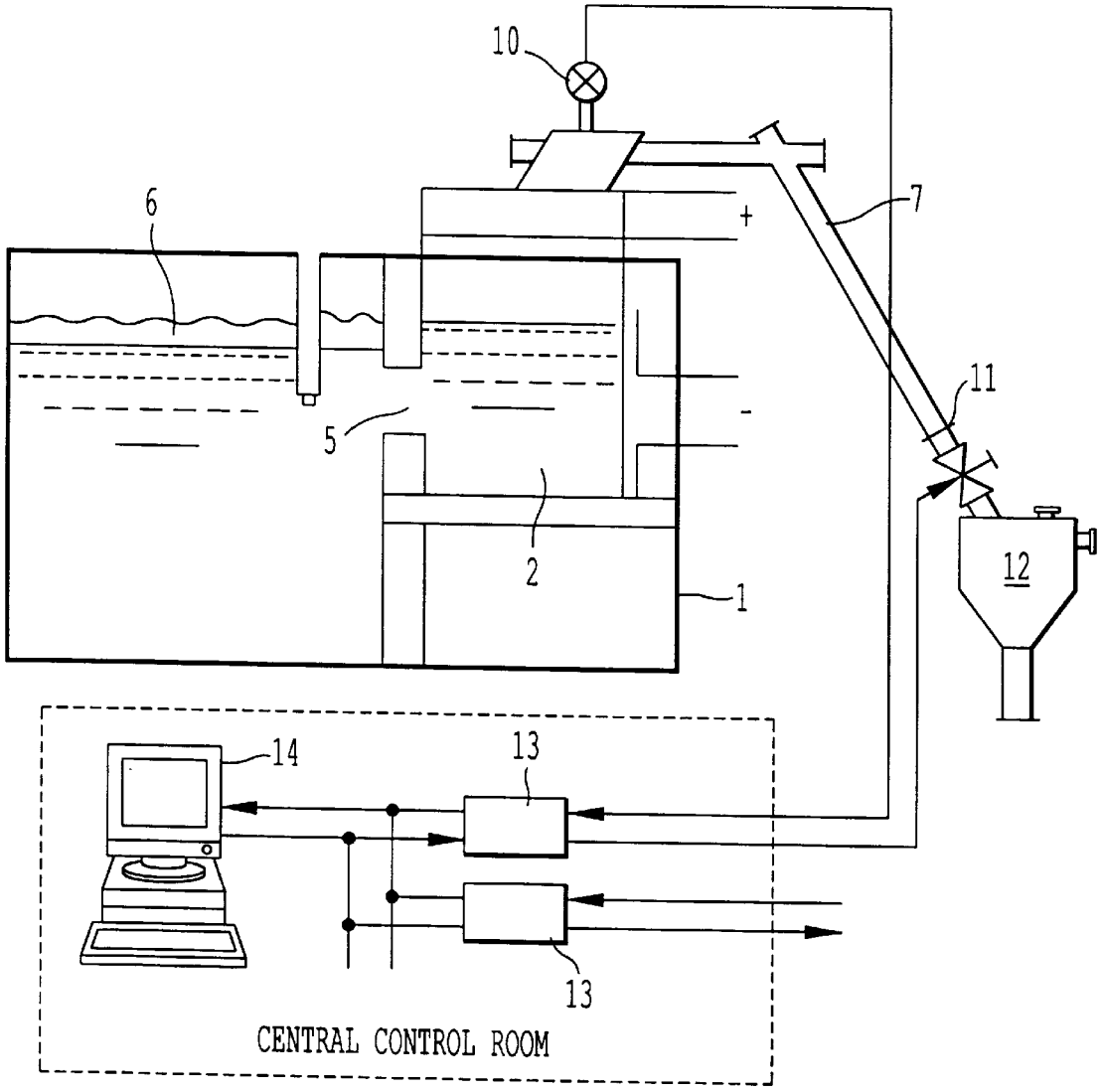
FIG. 2 is a schematic view illustrating the detailed configuration of the electrolytic cells and the control system of the present invention.

The metallic Mg electrolyzing device of the embodiment of the present invention comprises a plurality of electrolytic cells 1, 1 . . . , as shown in FIG. 1. Each electrolytic cell 1 electrolyzes $MgCl_2$ contained in molten salt 2 by means of the anode and cathode, as shown in FIG. 2.

The metallic Mg in a molten state produced on the side of the cathode by electrolysis passes through an inlet 5, floats on the molten salt 2 and forms a molten Mg layer 6. On the other hand, the $Cl_2$ gas produced on the side of the anode is sucked into a main pipe 8 through a branch pipe 7 and then transported to a $Cl_2$ gas refining equipment through the main pipe 8. In order to collectively suck the gas from the plurality of electrolytic cells 1, 1 . . . , a blower 9 as an aspirator is installed on the one side of the main pipe 8 which goes into the $Cl_2$ gas refining equipment.

In the metallic Mg electrolyzing device of the present embodiment, the suction pressure for sucking $Cl_2$ gas in each of the electrolytic cells 1, 1 . . . is controlled individually.

For this control, a pressure gage 10 for detecting suction pressure for sucking the $Cl_2$ gas is installed in each electrolytic cell 1, and a gate type automatic valve 11 with a positioner driven/controlled by air pressure is installed in each branch pipe 7 which introduces the $Cl_2$ gas produced in each electrolytic cell 1 to the main pipe 8. A dust bunker 12 is provided in the junctions between the branch pipes 7 and the main pipe 8. The branch pipes 7 are inclining down toward the dust bunker 12, and the automatic valve 11 is installed immediately in front of the dust bunker 12. The dust bunker 12 is something like a container in which powder chloride produced with the production Of $Cl_2$ gas is accumulated.

The suction pressure for sucking the $Cl_2$ gas detected by the pressure gage 10 is passed to a personal computer 14 via a controller 13 for controlling the positioner of the automatic valve 11. The personal computer 14 calculates one by one the operating amount of the positioner needed to make each and every suction pressure be the target value of within the range of −10 to 0 $mmH_2O$ (for example −4 $mmH_2O$) and issues commands to the controllers 13, 13 . . . . The controllers 13, 13 . . . send a control signal by means of air pressure change to each corresponding positioner of automatic valves 11, 11 . . . based on the commands from the personal computer 14.

The metallic Mg electrolyzing device of the present embodiment having such a constitution is characterized as follows.

Each and every suction pressure for sucking the $Cl_2$ gas produced in electrolytic cells 1, 1 . . . is controlled to the ideal value of an infinitesimal negative pressure or its approximation by controlling each positioner of the automatic valves 11, 11 . . . installed corresponding to the plurality of electrolytic cells 1, 1 . . . . This allows to control mixing of the atmospheric air in the plurality of electrolytic cells 1, 1 . . . as much as possible, which leads to the promotion of current efficiency. The current efficiency is also promoted by controlling molten surface level of the molten salt 2 to the constant, because such a control allows to appropriately maintain the bath convection in the electrolytic cells.

Since the automatic valves 11, 11 . . . are gate type, the clogging caused by powder chlorides produced with the production of $Cl_2$ gas is controlled, which enables the continuous use of the valves over a long period time. In addition, since the positioners of the automatic valves 11, 11 . . . are driven/controlled by air pressure, they are not affected by magnetic field generated by the large electric power used in the plurality of electrolytic cells 1, 1 . . . which allows them to operate properly. Further, since a single blower 9 collectively sucks gas from the plurality of electrolytic cells 1, 1 . . . , piping system becomes simple. Thus, individual control of negative pressure in the electrolytic cells 1, 1 . . . , which has been considered to be difficult, becomes possible; consequently, current efficiency is increased.

Moreover, in the metallic Mg electrolyzing device of the present embodiment, since branch pipes 7 are inclining down toward the main pipe 8, deposition of chlorides in the branch pipes 7 is avoidable effectively; in addition, since a dust bunker 12 is provided in the junctions between the branch pipes 7 and the main pipe 8 so that chlorides having passed through the branch pipes 7 shall be captured by it, deposition of chlorides in the main pipe 8 is also avoidable effectively. Further, since an automatic valve 11 is installed in the inclining down part of each branch pipe 7, clogging at the automatic valve 11 is more effectively avoidable.

In the metallic Mg electrolyzing devices of the prior art, though the control value of the suction pressure for sucking $Cl_2$ gas is set at a wide range of −10 to 0 $mmH_2O$ (−0.1 to 0 kPa), the rate of out of range deviation of the control value still reaches 50–75%, and electric power consumption rate is no less than 10310 kWH/T. On the contrary, in the metallic Mg electrolyzing device of the present embodiment, even though the control value of the suction pressure for sucking $Cl_2$ gas is set at a constant value of −4 $mmH_2O$ (−0.09 kPa), the rate of out of range deviation of the control value is no more than 25%, as a result, electric power consumption rate is improved to be 10185 kWH/T. In terms of current efficiency, it is increased by 1%.

INDUSTRIAL APPLICABILITY

As described above, the metallic Mg electrolyzing device of the present invention provides individual control of the suction of gas from a plurality of electrolytic cells and ensures a long-term operational stability of automatic valves used for the individual control of the gas suction; therefore, the suction pressure in each electrolytic cell can be controlled to the ideal infinitesimal negative pressure, which leads to decreasing electric power consumption rate very effectively. Accordingly, the metallic Mg electrolyzing device of the present invention enables the production of metallic Mg at a decreased cost and contributes to the reduction of the production costs of Ti, Zr and the like as well which are industrially produced from this metallic Mg by Kroll process.

What is claimed is:

1. A metallic Mg electrolyzing device provided with a plurality of electrolytic cells for forming metallic Mg by electrolysis of molten salts containing chloride of Mg, exhausting means for collectively sucking gas from the plurality of electrolytic cells by use of an aspirator installed in a main pipe through a plurality of branch pipes branching out from the main pipe in order to take out of the electrolytic cells a $Cl_2$ gas which is produced as a byproduct when forming metallic Mg in the plurality of electrolytic cells, each of said branch pipes being equipped with an automatic valve, and control means to detect the suction pressure for sucking $Cl_2$ gas in the plurality of electrolytic cells, thereby to control the opening degree of the automatic valve installed in each branch pipe, so that each detected pressure shall be controlled to the target value.

2. The metallic Mg electrolyzing device as claimed in claim 1, wherein said automatic valve is a gate valve.

3. The metallic Mg electrolyzing device as claimed in claim 1, wherein said automatic valve is a pneumatic valve which is driven by air pressure to be opened or closed, with the driving rate for opening/closing controlled by air pressure.

4. The metallic Mg electrolyzing device as claimed in claim 1, wherein said exhausting means transports the $Cl_2$ gas taken out of the plurality of electrolytic cells to a $Cl_2$ gas refining equipment.

5. The metallic Mg electrolyzing device as claimed in claim 1, wherein said target value of the suction pressure of $Cl_2$ gas from the plurality of electrolytic cells shall be set at −10 to 0 $mmH_2O$.

6. The metallic Mg electrolyzing device as claimed in claim 1, wherein said plurality of branch pipes branching out from the main pipe are inclining down toward the main pipe.

7. The metallic Mg electrolyzing device as claimed in claim 6, wherein said automatic valve is installed in the inclining down part.

8. The metallic Mg electrolyzing device as claimed in claim 6, wherein a dust bunker for capturing powder is provided in the junctions between the main pipe and the branch pipes.

9. The metallic Mg electrolyzing device as claimed in claim 2, wherein said automatic valve is a pneumatic valve which is driven by air pressure to be opened or closed, with the driving rate for opening/closing controlled by air pressure.

10. The metallic Mg electrolyzing device as claimed in claim 2, wherein said exhausting means transports the $Cl_2$ gas taken out of the plurality of electrolytic cells to a $Cl_2$ gas refining equipment.

11. The metallic Mg electrolyzing device as claimed in claim 3, wherein said exhausting means transports the $Cl_2$ gas taken out of the plurality of electrolytic cells to a $Cl_2$ gas refining equipment.

12. The metallic Mg electrolyzing device as claimed in claim 2, wherein said target value of the suction pressure of $Cl_2$ gas from the plurality of electrolytic cells shall be set at −10 to 0 $mmH_2O$.

13. The metallic Mg electrolyzing device as claimed in claim 3, wherein said target value of the suction pressure of $Cl_2$ gas from the plurality of electrolytic cells shall be set at −10 to 0 $mmH_2O$.

14. The metallic Mg electrolyzing device as claimed in claim 4, wherein said target value of the suction pressure of $Cl_2$ gas from the plurality of electrolytic cells shall be set at −10 to 0 $mmH_2O$.

15. The metallic Mg electrolyzing device as claimed in claim 2, wherein said plurality of branch pipes branching out from the main pipe are inclining down toward the main pipe.

16. The metallic Mg electrolyzing device as claimed in claim 3, wherein said plurality of branch pipes branching out from the main pipe are inclining down toward the main pipe.

17. The metallic Mg electrolyzing device as claimed in claim 4, wherein said plurality of branch pipes branching out from the main pipe are inclining down toward the main pipe.

18. The metallic Mg electrolyzing device as claimed in claim 5, wherein said plurality of branch pipes branching out from the main pipe are inclining down toward the main pipe.

19. The metallic Mg electrolyzing device as claimed in claim 7, wherein a dust bunker for capturing powder is provided in the junctions between the main pipe and the branch pipes.

* * * * *